United States Patent [19]

Michaelis

[11] 4,053,210

[45] Oct. 11, 1977

[54] TRANSLUCENT BUILDING BLOCKS

[76] Inventor: Maximilian Gustav Alfred Cecil Michaelis, 13 Quai St. Michel, Paris V, France

[21] Appl. No.: 537,008

[22] Filed: Dec. 27, 1974

Related U.S. Application Data

[63] Continuation-in-part of Ser. No. 445,699, Feb. 25, 1974, Pat. No. 3,954,326.

[30] Foreign Application Priority Data

| | | |
|---|---|---|
| Jan. 3, 1974 | United Kingdom | 273/74 |
| Jan. 25, 1974 | United Kingdom | 41576/74 |
| Apr. 2, 1974 | United Kingdom | 41786/74 |
| Apr. 30, 1974 | United Kingdom | 41977/74 |
| Sept. 17, 1974 | United Kingdom | 43428/74 |

[51] Int. Cl.[2] ..... E04C 1/42

[52] U.S. Cl. ..... 350/262; 350/265; 52/306

[58] Field of Search ..... 350/258, 259, 260, 261, 350/262, 264, 265; 52/171, 172, 306, 307, 308

[56] References Cited

U.S. PATENT DOCUMENTS

| | | | |
|---|---|---|---|
| 1,342,404 | 6/1920 | D'Harlingue | 52/306 |
| 2,179,862 | 11/1939 | Rolph | 52/306 |
| 2,179,863 | 11/1939 | Rolph | 350/260 |
| 3,252,260 | 5/1966 | Mills | 52/308 X |
| 3,798,861 | 3/1974 | Weiss | 52/306 |
| 3,954,326 | 5/1976 | Michaelis | 350/265 |

FOREIGN PATENT DOCUMENTS

| | | | |
|---|---|---|---|
| 1,294,308 | 10/1972 | United Kingdom | 350/258 X |

*Primary Examiner*—L. T. Hix
*Assistant Examiner*—Alan Mathews
*Attorney, Agent, or Firm*—Seidel, Gonda & Goldhammer

[57] ABSTRACT

For use in a window area of a building, an assembly comprises several generally rectangular translucent building blocks each containing a transparent liquid and an oblique reflecting/refracting surface in contact with the liquid, for pleasing visual effect. The oblique surface intersects, or if produced would intersect, a plane face of the block along a line parallel to one of the rectangular axes.

9 Claims, 13 Drawing Figures

TRANSLUCENT BUILDING BLOCKS

RELATED APPLICATION

This is a continuation-in-part of my copending U.S. application Ser. No. 445,699, filed Feb. 25, 1974, now U.S. Pat. No. 3,954,326.

FIELD OF THE INVENTION

This invention relates to translucent building blocks, and more especially to building blocks which are an improvement on the block described in my above-mentioned Patent Application Ser. No. 445,699, itself an improvement upon that in my British patent specification No. 1,294,308.

DESCRIPTION OF THE PRIOR ART

In patent specification No. 1,294,308, there is described a building block comprising a hollow transparent body partially filled with a liquid and having at least one oblique wall such that light can be reflected through the body of the block by total internal reflection at a portion of the oblique wall immersed in said liquid. Such a building block, if desired in combination with a number of other such blocks, has the advantage that it is capable of transmitting light through a wall in a novel and visually attractive manner. However, where the thickness of the wall is limited, and the block is required to be accommodated within the thickness of the wall, the presence of the oblique wall of the block has the disadvantage of reducing the load-bearing capacity of the structure.

OBJECT OF THE INVENTION

It is accordingly an object of the present invention to overcome this disadvantage.

My copending Application No. 445,699 describes a hollow building block of transparent material comprising four perpendicular walls defining a rectangle, and a partition wall or insert extending obliquely with respect to a plane at right angles to said perpendicular walls, said partition wall forming a boundary of a hollow space within said building block for containing liquid and the arrangement being such that when said hollow space is partially filled with a transparent liquid, light incident upon one of said perpendicular walls of the block can be reflected through said block by total internal reflection at a portion of said oblique wall immersed in said liquid.

The arrangement there described has the advantage that the four perpendicular walls of the block form a load-bearing structure, whilst the oblique partition wall in combination therewith provides a light transmitting arrangement having optical characteristics similar to the building block of patent specification No. 1,294,308.

SUMMARY OF THE INVENTION

The present invention relates to translucent building blocks having any device or means, such as a slip of glass or other insert, for producing a prism in the block of a different (usually higher) refractive index than the remainder of the body of the block; the prism may be solid, e.g., of plastics, or liquid, e.g. of water, which may be coloured. The remainder of the body of the block may be of air or coloured gas.

The present invention also provides a module comprising a plurality of building blocks as set forth above arranged in a rectangular frame vertically and horizontal adjacent to one another, the module being adapted to form part of a wall structure of a building.

BRIEF DESCRIPTION OF DRAWINGS

The invention will now be described by way of example with reference to the accompanying drawings, in which.

DETAILED DESCRIPTION OF DRAWINGS

Figure 1:
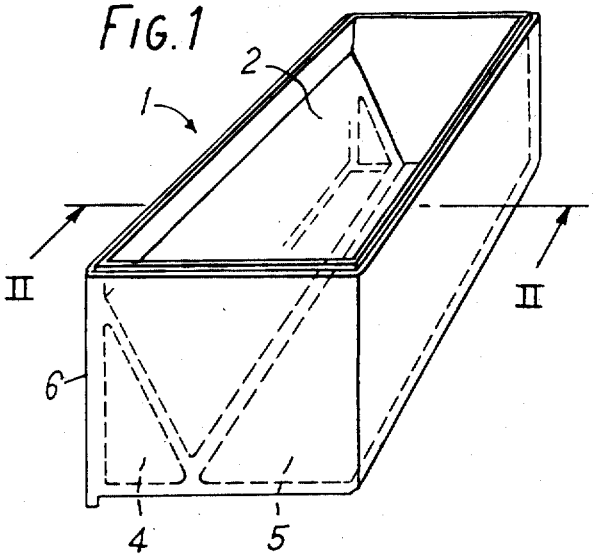
FIG. 1 is a perspective view of a building block according to Ser. No. 445,699.

In FIG. 1, a generally rectangular open topped building block 1 of a transparent material such as glass comprises four rectangular side walls. A partition wall 2, of the same transparent material, is formed obliquely to a floor 5 of the block but nonetheless perpendicular to the ends (the block being viewed end-on in FIG. 1). The wall 2 extends from end to end of the block 1. The floor 5 however does not extend beyond the left (FIG. 2) of the partition wall 2; thus it leaves a gap 4.

It will be seen that the base of the block 1 has angled recessed longitudinal edges conforming with longitudinal angled projections in the top of the block, whereby blocks can be stacked and positively located. In practice, stacked blocks would be cemented together, but during assembly the projections and recesses will be of assistance. Various arrangements are possible.

Figure 4:
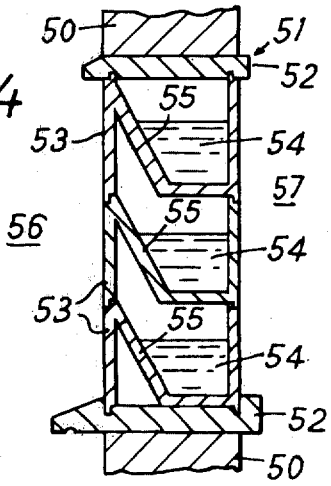
FIG. 4 is an end view of a module containing three superimposed blocks made in the mould of FIG. 3.

In use, the block 1 is partially filled with a transparent liquid 7 such as water; then several like blocks are stacked one upon another, generally as shown in FIG. 4. The arrows in FIG. 2 illustrate the path of travel of light rays as they enter the block and are transmitted therethrough by internal reflection and refraction.

If desired, the block 1 may, after receiving the liquid 7, be closed by a slip of glass (not shown) cemented to the top of the block 1 and so dimensioned as to seal the volume containing the liquid 7 without interfering with the superimposition of the next block 1. In such a case, the volume not occupied by the liquid 7 can contain a coloured gas.

Figure 2:
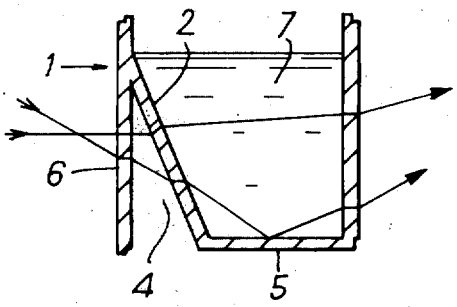
FIG. 2 is a cross-section of the building block of FIG. 1, taken along the line II—II.
Figure 3:
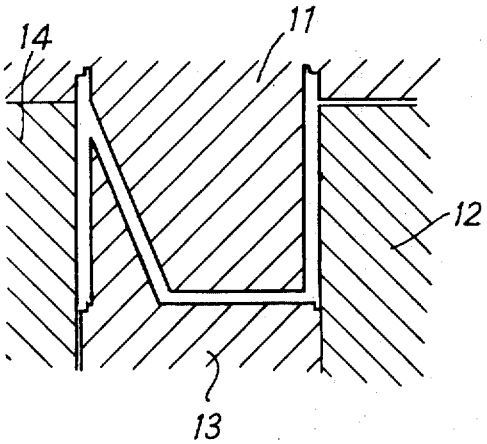
FIG. 3 is a cross-section of a mould for another building block according to Ser. No. 445,699.

FIG. 3 shows a mould for forming a building block as shown in FIGS. 1 and 2.

Bottom and top parts 13 and 11 define the upper and lower limits of the block, while side parts 12 and 14 define the lateral limits. Between the bottom part 13 and the side part 14 a sprue is defined, and between the top part 11 and the side part 12 another sprue is defined.

FIG. 4 shows a vertical cross-section of a module according to the invention. A wall 50 of a building has an aperture in which is inserted a module 51. The module comprises a rectangular frame 52 formed as a window frame and contains in superimposition a plurality of, for example, three rectangular building blocks 53 similar to those resulting from the mould of FIG. 3 and according to the invention. The module may include any number of horizontally adjacent blocks.

Transparent liquid 54 in each block reaches the obliquely formed internal wall 55. All joints in the module are, of course, hermetically sealed where necessary to prevent leakage or evaporation of the liquid 54.

Figure 5:
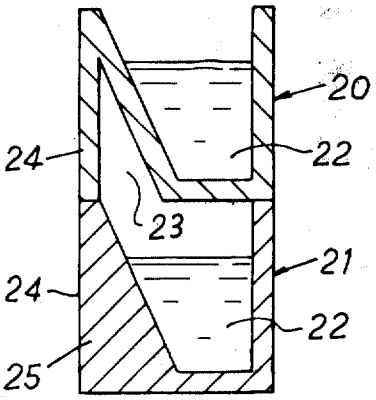
FIG. 5 is a cross-section of a module comprising two superimposed building blocks according to Ser. No. 445,699.

In the eventuality of incident light emanating from below the horizontal, the oblique walls would be arranged in the opposite sense to that shown in FIG. 5, so that they still extended generally parallel to the incident light.

Examples of further building blocks of Ser. No. 445,699 are shown in FIG. 5 of the accompanying drawings, in which, as seen in end elevation, an open-topped glass building block 20, with its base smaller than its top but otherwise generally rectangular, is superimposed on a generally similar block 21. Both contain a translucent liquid such as water 22.

A downward extension 24 of the block 20 causes the area 23 of the open top of the block 21 not covered by the base of the block 20 to be sealed; the rectangular ends of the blocks 20, 21 (parallel to the plane of the paper of FIG. 5) consists of glass walls. This design offers a seal all round and obviates the need for the flat seal previously used to enclose the liquid when consecutive bricks were reversed.

The volume 25 represents a reduced reverse of the volume in which the liquid is placed and can be partly or (as shown) in whole filled in with glass, depending on technical considerations. Contact of the inclined plane with the water 22 provides a reflecting/refracting surface. The solid glass volume 25 may indeed offer convenient facilities in producing a mould.

A wall consisting of blocks 21 stacked can also have consecutive blocks reversed without needing any extra seals to retain the water 22 or other liquid.

Figure 6A:
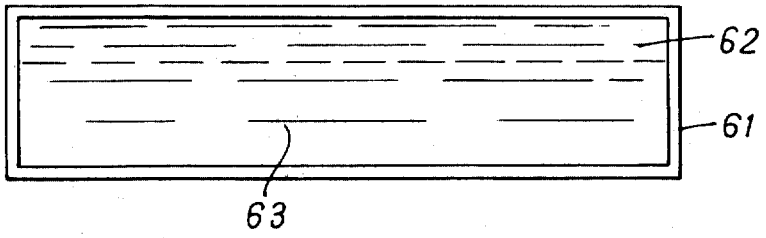
FIG. 6 shows a building block according to Ser. No. 445,699, FIG. 6*a* being a plan, FIG. 6*b* a schematic U.S. end elevation to an enlarged scale and FIG. 6*c* an oblique isometric drawing.
Figure 6B:
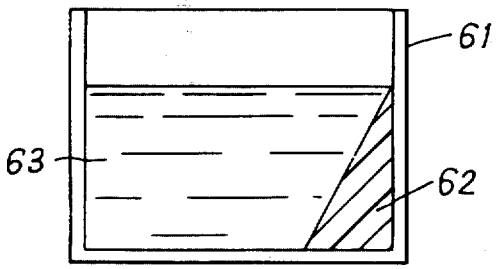
Figure 6C:
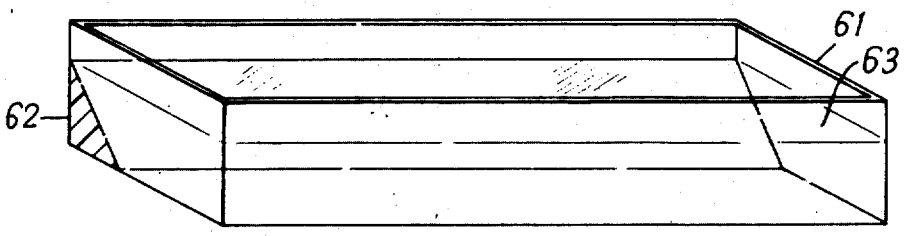

Turning now to FIG. 6, showing a block according to Ser. No. 445,699, an open-topped hollow orthorhombic glass block 61 contains an insert 62 of perspex (a transparent plastics material prepared by the polymerisation of methyl methacrylate). The insert 62 could alternatively be of glass or any other transparent solid. The insert 62 is a right cylinder of right-triangular section and fits snugly in a corner of the block 61 intended to be horizontal and parallel to the plane of the wall of which the block is to form part. The insert 62 is just as long as the relevant interior dimension of the block.

The block 61 contains a transparent liquid such as water 63 which reaches the level of the top edge of the insert 62. The (sloping) boundary between the perspex insert 62 and the water 63 constitutes a refracting/totally-internally-reflecting surface giving rise to the visual effects sought by the invention.

The advantage of this construction is economy, since the block 61, having walls of equal thickness throughout, is easily moulded and the insert 62 is of a light, material and in itself has a simple shape to be fabricated.

The insert 62 may be formed by pouring a liquid into the block of FIG. **6*b* to set or cure in situ, the block being held rotated 66° clockwise from its FIG. 6*b*** position; suitable liquids are polyester resin or acrylics.

Figure 7A:
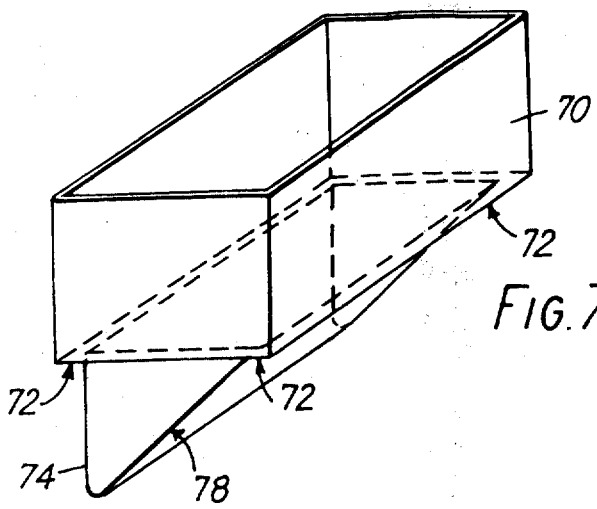
FIG. 7*a* shows a translucent hollow block of the invention.
Figure 7B:
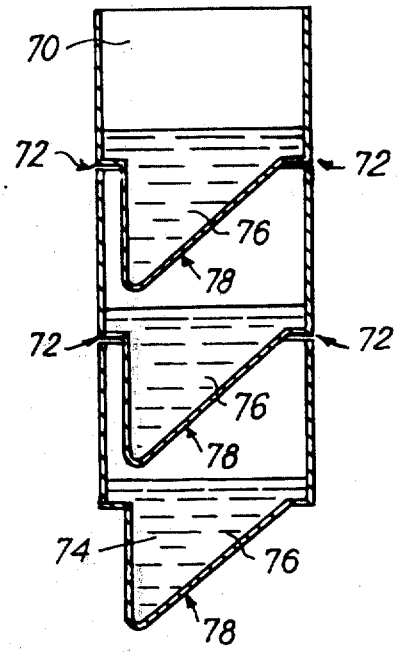
FIG. 7*c* shows superimposed blocks of the design of FIG. 7*a*.

FIG. 7 shows a block according to the invention.

The block of FIg. **7*a*, of glass, consists of an open-topped hollow orthorhombic figure the base of which is extended, leaving a small flange 72, to form a trough 74** in the shape of a depending prism, which may be for example right-triangular.

Sufficient liquid 76 such as water is placed in the block to fill the trough 74. A small excess of liquid 76 can be tolerated since this will merely begin to fill the orthorhombic part 70.

The wall 78 forming the hyptoenuse of the trough 74 and covered on one side with the liquid 76 acts as a reflector and provides an oblique reflecting/refracting surface as in the other examples.

More generally, the liquid 76 can, at will, more than fill, exactly fill, or incompletely fill the trough 74. The required reflecting and refracting surfaces may arise if each block contains liquid 76, or if, alternatively, alternate blocks contain liquid 76. Other patterns may be conceivable.

As shown in FIG. **7*b*, the trough 74 of each block of FIG. 7*a* partly fills the orthorhombic part 70 of the next lower block. Each block is supported at its flange 72,** which rests on the upper edges of the orthorhombic part of the next lower block. The orthorhombic part of such a block may be of standard dimensions (e.g. $3 \times 4\frac{1}{2} \times 9$ inches) and the presence of the prismatic trough does not affect the building calculations as to quantity etc., except that special provision would be made to accommodate the lowest block of a wall.

An example of a further block according to the invention is illustrated in FIG. **8*a*.**

A translucent building block 80 comprises, in its normal attitude, four perpendicular or near perpendicular vertical walls, usually two longer and two shorter. The top may be open or closed as desired, and is preferably open for ease of manufacture.

The base is recessed and comprises two oblique planar walls 81, 82 meeting in a ridge 83 running parallel to the planes of the two longer walls of the block and (usually) normal to the shorter walls. Thus, in effect, the block 80 has a triangular prism projecting upwardly therein. It will be recalled how the block of FIG. 7 has a triangular prism depending therefrom.

The cavity defined by the wall 81, the contiguous longer vertical wall and the shorter vertical walls, may contain a translucent optionally coloured liquid or solid 84, up to any depth but preferably just level with the ridge 83.

The block 80 is intended to form, with other like bricks stacked thereon, part of a wall of a building. The four vertical walls of each block impart good load-bearing properties and rigidity thereto. This embodiment is shown in FIG. **8*b*.**

It is possible to form a wall using blocks 80 upside down relative to the above description. In this case as shown in FIG. **8*c*, the translucent solid or liquid 85 is contained by the trough constituted by the oblique walls 81, 82. The shorter vertical walls of each block may in this case, as formerly, either be rectangular or the triangle between the walls 81, 82 and the top (base in the attitude of FIG. 8**) may be omitted, some part of the building itself serving to define the horizontal limits of the trough.

Figure 8B:
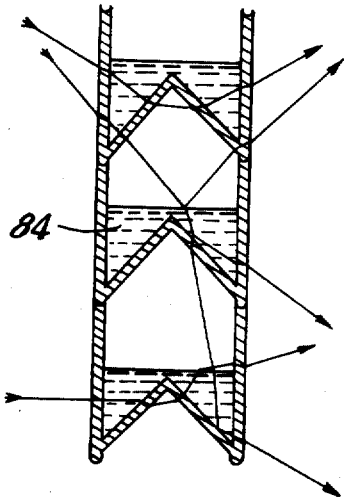
FIG. 8*b* is a cross-section of a module comprising three superposed blocks of the design of FIG. 8*a*.
Figure 8C:
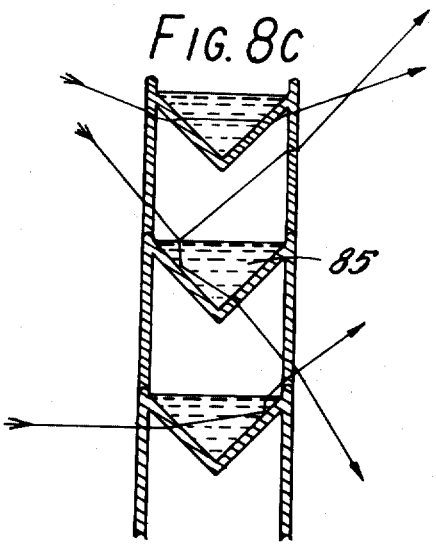
FIG. 8*c* is a cross-section of a module comprising three superposed blocks of the design of FIG. 8*a* wherein the blocks are all inverted from the disposition shown in FIG. 8*a* and 8*b*.
Figure 8A:
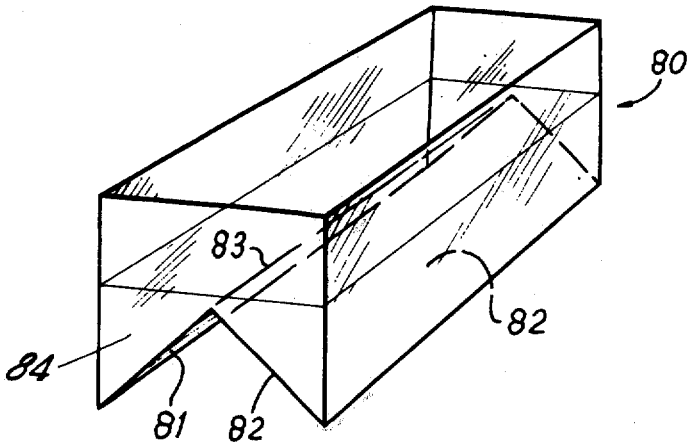
FIG. 8*a* shows a further building block according to the invention.

Apart from ease of manufacture and good mechanical properties, blocks according to FIG. 8*a* are easily built up into walls without requiring supplementary pieces, spacers or the like. The arrows in FIG. 8*b* and 8*c* illustrate the path of travel of light rays through modules of superposed blocks as shown in FIG. 8*a*. The cooperation between the solid or liquid material 84 and 85 with the oblique walls 81 and 82 produce total internal reflection as indicated by the paths of travel of light rays. Depending on the angle of incidence, light is transmitted through the block by total internal reflection, refraction or both.

I claim:

1. In an article of manufacture in the form of a hollow translucent block having substantially vertical and substantially parallel side walls connected to substantially vertical and substantially parallel end walls, said side walls being longer than said end walls, said side walls and said end walls being connected to a bottom wall, the improvement comprising said bottom wall being defined by at least two oblique portions each forming an acute angle with respect to said side walls, said oblique portions having smooth upper and lower surfaces, said oblique portions converging to a ridge within said block, each side wall cooperating with the adjacent one of said oblique portions to form first and second trough portions, at least one of said trough portions being at least partially filled with a transparent liquid such that said liquid cooperates with the oblique portions with which it is in contact to transmit at least some light incident on said side walls through said block by total internal reflection and refraction.

2. The improvement of claim 1 wherein said ridge is substantially parallel to said side walls of said block.

3. A window structure including at least two of the translucent blocks of claim 1 in superposed relation.

4. The improvement of claim 1, wherein said transparent liquid is coloured.

5. The improvement of claim 1, wherein said transparent liquid is water.

6. The improvement of claim 1, further comprising a coloured gas in any volume left vacant by the liquid.

7. In an article of manufacture in the form of a hollow translucent block having substantially vertical and substantially parallel side walls connected to substantially vertical and substantially parallel end walls, said side walls being longer than said end walls, said side walls and said end walls being connected to a bottom wall, the improvement comprising said bottom wall being partially defined by a horizontal flange portion substantially perpendicular to said side walls and said end walls, and extending inwardly from said side walls and said end walls, and said bottom wall being partially defined by a hollow, depending portion having the shape of a right triangle, wherein a side wall of said depending portion lies in a plane substantially parallel to one of said side walls of said block and is connected to said flange portion, the end walls of said depending portion lie in a plane substantially parallel to the end walls of said block and are connected to said flange portion and wherein the other wall of said depending portion comprising a hypotenuse forms an oblique angle with said side wall of said depending portion by being connected at its lower end to said side wall of said depending portion and connected at its upper end to said flange portion, all of said walls and said hypotenuse having smooth surfaces, and said depending portion being at least partially filled with a liquid such that said liquid cooperates with said hypotenuse to transmit at least some light incident on said side walls of said block and said depending portion through said block by total internal reflection and refraction.

8. A window structure including at least two of the blocks of claim 7 in superposed relation.

9. A window structure comprising at least two superimposed translucent blocks, each of said blocks having substantially vertical and substantially parallel first and second walls connected to substantially vertical and substantially parallel third and fourth walls, said first and second walls being longer than said third and fourth walls, said walls being connected to a fifth wall, said fifth wall being defined by at least two oblique portions each forming an acute angle with respect to said first and second walls, said oblique portions having smooth upper and lower surfaces, said oblique portions converging to a ridge within said block, the cross-section of said blocks being W-shaped when said blocks are in a first position and M-shaped when said blocks are in a second position inverted from said first position, said blocks being at least partially filled with a transparent liquid which cooperates with said oblique portions with which said liquid is in contact to transmit at least some light incident on said first and second walls through said block by total internal reflection and refraction.

* * * * *